US005383386A

United States Patent [19]

Kudo et al.

[11] Patent Number: 5,383,386

[45] Date of Patent: Jan. 24, 1995

[54] TONE SIGNAL GENERATING DEVICE

[75] Inventors: Masaki Kudo; Tokio Shirakawa, both of Hamamatsu, Japan

[73] Assignee: Yamaha Corporation, Japan

[21] Appl. No.: 46,394

[22] Filed: Apr. 14, 1993

Related U.S. Application Data

[63] Continuation of Ser. No. 637,298, Jan. 3, 1991, abandoned.

[30] Foreign Application Priority Data

Jan. 5, 1990 [JP] Japan ..... 2-312

[51] Int. Cl.[6] ..... G10H 7/08

[52] U.S. Cl. ..... 84/622; 84/624

[58] Field of Search ..... 84/622-625, 84/604-607; 384/749, 768, 784, 786

[56] References Cited

U.S. PATENT DOCUMENTS

| | | | |
|---|---|---|---|
| 4,177,706 | 12/1979 | Greenberger | 84/625 |
| 4,343,218 | 8/1982 | Fotamose | 84/625 |
| 4,554,857 | 11/1985 | Nishimoto | 84/624 |
| 4,572,048 | 2/1986 | Franz et al. | 84/622 |
| 4,622,877 | 11/1986 | Strong | 84/604 |
| 4,707,800 | 11/1987 | Montrone et al. | 364/749 X |
| 4,736,663 | 4/1988 | Wawrzynek et al. | 84/DIG. 9 |
| 4,928,569 | 5/1990 | Kudo et al. | 84/626 |

FOREIGN PATENT DOCUMENTS

| | | |
|---|---|---|
| 63-125990 | 5/1988 | Japan . |
| 1-101599 | 4/1989 | Japan . |

OTHER PUBLICATIONS

"Musical Applications of Microprocessors", Chamberlin, Hayden Book Company, 1985, pp. 421-427, 672-676.

*Primary Examiner*—Jonathan Wysocki
*Assistant Examiner*—Brian Sircus
*Attorney, Agent, or Firm*—Graham & James

[57] ABSTRACT

An addition section and a memory section for storing data to be inputted to the addition section are provided. A processing section variably performs a logical processing on output data of the memory section in accordance with a control signal and gives the data to the addition section. A control section controls introduction of data to the memory section and supply of the control signal to the processing section in correspondence to respective desired operations so that plural kinds of operations for tone signal generation may be respectively performed. With this arrangement, the addition section can be shared for various kinds of operations for the tone signal generation. Consequently, operation circuits for performing the various operations are integrated, so as to realize a substantial reduction of circuitry construction.

13 Claims, 7 Drawing Sheets

TONE SIGNAL GENERATING DEVICE 10

TONE DATA RAM36: FOR 1 CHANNEL

DATA MEMORY 27

TONE SIGNAL GENERATING DEVICE

This is a continuation of copending application Ser. No. 07/637,298 filed on Jan. 3, 1991, now abandoned.

BACKGROUND OF THE INVENTION

This invention relates to a tone signal generating device which can be used in an electronic musical instrument, or in other tone generating or synthesizing instruments, and more particularly to the device which can be simplified in circuitry required for various operations for tone signal generation.

Many kinds of operations are performed for generating a tone signal. Among them are, for example, a phase address signal operation for tone waveform generation, an envelope waveform signal generation operation, an amplitude level scaling operation with respect to a tone waveform signal, and a tone waveform interpolation operation. Such operations have conventionally been performed by individual dedicated operation circuits. Also some of the above mentioned operations involve further operations for scaling coefficients or accumulating data, which have also been performed by individual dedicated operation circuits, coefficient scaling multipliers and accumulators. For example, Japanese patent laid-open publication No. Sho 63-125990 (corresponding to U. S. Pat. No. 4,928,569) discloses an envelope waveform generating device in which various operations are performed by individual dedicated circuits.

As another example, Japanese patent laid-open publication No. Hei 1-101599 discloses the feature of using a common operation circuitry on time divisional basis for performing an operation for scaling the amplitude of a tone waveform signal by an interpolation coefficient used in interpolation operation of a tone waveform sample value along with an operation for scaling the amplitude of a tone waveform signal by an envelope coefficient.

However, there arises a problem that the number of required operation circuits and the size of overall circuitry tend to increase, if various operations for tone signal generation are performed by individual dedicated operation circuits as in the prior art.

Further, in the prior art where operations for scaling the amplitude of a tone waveform signal by an interpolation coefficient and by an envelope coefficient are performed in a common circuitry, circuitry reduction can be attained only in an extremely slight degree. Sharing an operation circuitry for operations of similar characteristics as mentioned can only provide an extremely limited level of circuitry reduction.

SUMMARY OF THE INVENTION

It is therefore an object of the present invention to provide a tone signal generating device in which operation circuits for performing various operations are integrated so as to realize a substantial reduction of circuitry construction.

For achieving the object, a tone signal generating device according to the present invention comprises an addition section, a memory section for storing data to be inputted to the addition section, a processing section for variably performing a logical processing on output data of the memory section in accordance with a control signal and giving the data to the addition section, and a control section for controlling introduction of data to the memory section and supply of the control signal to the processing section in correspondence to respective desired operations so that plural kinds of operations for tone signal generation may be respectively performed, the data to be introduced to the memory section and contents of the logical processing of the processing section being determined in accordance with a control of the control section, so that the addition section can be shared for various kinds of operations the tone signal generation.

In the present invention, the addition section may be so constructed as to change the number of its effective bits in accordance with the control signal given from the control section. In that case, the addition section may include a plurality of addition circuits connected with each other between their carry signal output and input via a gate, and it may selectively enable one or more of the addition circuits by controlling the gate in accordance with the control signal given from the control section, in such manner that the number of the effective bits of the entire addition section can be changed.

Further, the adder section may be separable into two or more independent addition circuits and capable of performing different operations in parallel in the respective independent addition circuits. In that case, the addition section, similarly to the above, may include a plurality of addition circuits connected with each other between their carry signal output and input via a gate, and it may separate or operatively connect the plurality of the addition circuits by controlling the gate in accordance with the control signal given from the control signal.

Predetermined data is introduced into the memory section and the contents of logical processing by the processing section is determined based on the controls by the control section and depending on the purpose of the operation. Hence, the addition section is set for performing the operation directed to the purpose. The control section controls the introduction of the respective predetermined data and the supply of the control signal. With this arrangement, the addition section is shared for plural kinds of operations for tone signal generation.

In this manner, operation circuits for performing various operations for tone signal generation can be integrated into a single addition section, and thus substantial reduction of circuitry can be realized. Accordingly, when a tone signal generating device is to be made in the form of an integrated circuit, the size of the integrated circuit can be substantially reduced.

Among various operations for tone signal generation which share a single addition section are, for example, a phase address signal operation for tone waveform generation, an envelope waveform signal generation operation and an amplitude level scaling operation with respect to a tone waveform signal. The addition section may be shared for a tone waveform interpolation operation as well. Since in this invention, there are provided a memory section, a processing section and a control section so that the addition section can be used completely multipurposely, the addition section can be shared for operations of entirely different characteristics, and various operations for tone signal generation can be performed by a single addition section.

The feature that the addition section is capable of changing the number of its effective bits in accordance with the control signal given from the control section is extremely advantageous in sharing a single addition section for operations on data of various different characteristics. In other words, in order to achieve the multipurpose use of the addition section, it is preferable that the addition section has as many bits as possible for data of many bits. If the addition section has relatively many bits, the system must be constructed as to reserve enough calculation time for the time required for carries of individual digits. Of various data, some data may have relatively few bits. If the adder section of many bits is also used for operation of such few bit data, much time more than necessary will be undesirably reserved. In this respect, if the effective bit number of the addition section is changeable in accordance with the control signal as in the present invention, the effective bit number can be properly reduced so that it is possible to construct a system in which only relatively short calculation time is reserved in the case of operations of few bit data. In this manner, efficient allocation of calculation time can be achieved in correspondence to the characteristics of the data sharing the addition section.

Another feature that the addition section is separable into two or more independent addition circuits and is capable of performing in parallel different operations in the respective addition circuits is, similarly to the above, extremely advantageous in sharing a single addition section for operations of data of various different characteristics. In more specific terms, the addition section is unseparatedly used for an operation of data of many bits, while it is separatedly used for an operation of data of few bits so that different operations of different data are performed in parallel in the respective addition circuits; operation efficiency can be improved by such parallel operations.

In a case where the addition section is shared for n kinds of operations, for example, it will be necessary to use the addition section on n time divisions if simply stated; however, if parallel operations are partially performed in accordance with the present invention, required time division number m will not be more than the total number of single and parallel operations and thus $m<n$, with the result that the entire processing time can be effectively shortened.

Now, embodiments of the present invention will be described with reference to the accompanying drawings.

BRIEF DESCRIPTION OF THE DRAWINGS

In the accompanying drawings.

DETAILED DESCRIPTION OF THE PREFERRED EMBODIMENTS

Figure 1:
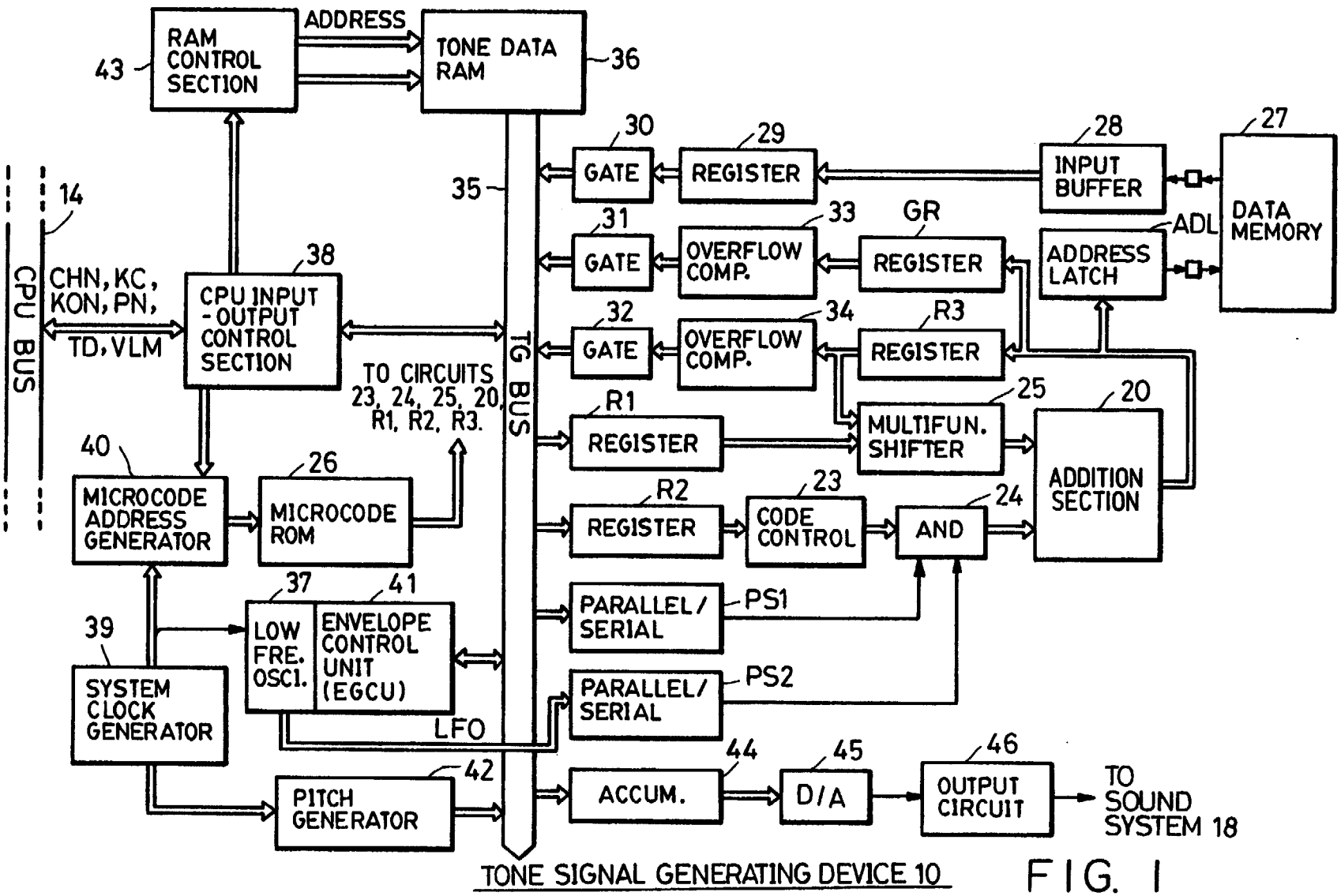
FIG. 1 is a block diagram illustrating a hardware arrangement of an embodiment of a tone signal generating device according to the present invention.
Figure 2:
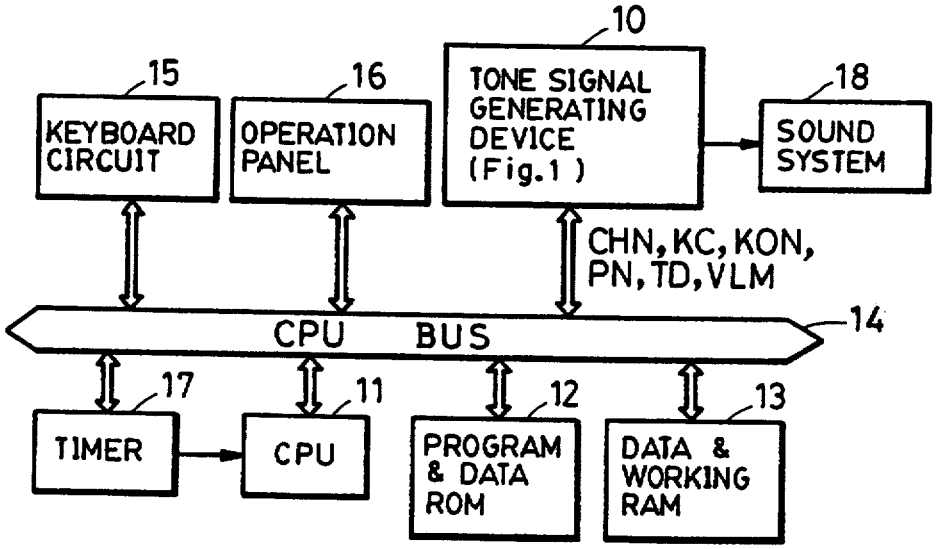
FIG. 2 is a block diagram illustrating a hardware arrangement of an example electronic musical instrument incorporating the tone signal generating device according to the present invention.

FIG. 1 is a block diagram illustrating a hardware arrangement of an embodiment of a tone signal generating device in accordance with the present invention, and FIG. 2 is a block diagram illustrating a hardware arrangement of an example electronic musical instrument incorporating the tone signal generating device of the invention, FIG. 1 specifically illustrating an example circuitry within the block of the tone signal generating device 10 shown in FIG. 2.

Referring now to FIG. 2, in the example electronic musical instrument, various processes are implemented under the controls by a microcomputer which comprises a central processing unit (CPU) 11, a program and data ROM 12, and a data working RAM 13. The tone signal generating device 10, a keyboard circuit 15, an operation panel 18 and various other circuits are connected to the microcomputer via a CPU bus 14.

The keyboard circuit 15 is provided in corresponding relations with a keyboard having a plurality of keys each for designating a tone pitch of a tone to be generated, and it includes key switches corresponding to the respective keys of the keyboard.

The operation panel 16 includes a variety of operators for selecting, setting and controlling a tone color, tone volume, tone pitch, tone effect and so on.

A timer 17 is provided for generating time data to be used in tone controls that change with time, and also providing interruption signals to CPU 11.

Through the microcomputer processes, the individual key switches of the keyboard 15 are scanned for detection of their on-off states, and a depressed key is assigned to any of plural tone generation channels. Also, a process for detecting a key touch is implemented, as required. Further, various operators or switches are scanned for detection of their on-off states, on the basis of which detection of a selected tone color and other processes are implemented. When there has occurred a change in the contents of assignment to any of the tone generation channels or in the operation conditions of the operation panel 16, the CPU 11 gives necessary data to the generating device 10 via the CPU bus 14. Among such data given from CPU 11 to the tone signal generating device 10 are for example: a channel number CHN indicative of the assigned channel ; a key code KC indicative of the key assigned to a channel; and a key-on signal KON indicative of whether the key is being depressed or has been released; a P number PN that is a numerical value corresponding to the tone pitch of the key; touch data indicative of a key touch of the key at the time of depression; a voice number indicative of a selected tone color VN; and tone volume setting data VLM indicative of tone volume as manually set or adjusted.

The tone signal generating device 10 generates tone signals in plural channels on the basis of the data given from the CPU 11. The generated tone signals are supplied to a sound system 18 to be sounded acoustically.

Now, the tone signal generating device 10 will be described with reference to FIG. 1.

Description on the General Hardware Circuits

The tone signal generating device 10 includes an addition section 20 to be used multipurposely for various kinds of operations for tone signal generation.

The device 10 also includes a plurality of memory circuits such as registers R1, R2, R3 for storing data to be inputted to the addition section 20. Further, the device 10 includes processing circuits, such as a code control circuit 23, AND circuit 24 and multifunctional shifter 25, for variably implementing logical processes on output data of these memory circuits in accordance with control signals. The logical processes to be implemented in the processing circuits are such as shifting, gating, selection, inversion etc. of data, and any desired process is effected in accordance with the control signals. The code control circuit 23 is provided to effect a code control process for subtraction operation, the AND circuit 24 to effect an AND process such that a partial product is obtained for multiplication operation, and the multifunctional shifter 25 to serve various functions such as shifting, selection, passage, blockage and temporary storage of data etc.

To realize plural kinds of operations for tone signal generation, the tone signal generating device 10 includes control circuits, such as a microcode ROM 26 and other circuits related thereto, for controlling the data introduction to the memory circuits as well as the supply of the control signals to the processing circuits. Among various operations for tone signal generation that are controlled by the control circuits to share the addition section 20 are for example a phase address signal operation for tone waveform generation, an envelope waveform signal generation operation, an amplitude level scaling operation with respect to a tone waveform signal and a tone waveform interpolation operation. A data memory 27 is a read-only memory storing waveform sample data corresponding to various tone colors as well as envelope parameter data corresponding to various envelope waveforms, and the memory 27 is, because of its large capacity, provided outside the integrated circuit chip constituting the tone signal generating device 10.

Output data of the addition section 20 is given to an address latch ADL, whose output in turn is given to an address input of the data memory 27. Data output of the data memory 27 is applied to an input buffer 28, then held temporarily in a register 29 and thence given to a TG bus (tone generator bus) 35 through a gate 30. The TG bus 35 is connected to a tone data RAM 36 and other circuits within the tone signal generating device 10, such as the registers R1; R2.

The output of the addition section 20 is connected to a register GR. The output of this register GR is applied to a gate 31 through an overflow compensation circuit 33, the output of the gate 31 being connected to the TG bus The output of the addition section 20 is also connected to a register R3. The output of this register R3 is applied to a gate R2 through an overflow compensation circuit 34, the output of the gate 32 being connected to the TG bus 35. The output of the register R3 is connected to the multifunctional shifter 25, the output of which is in turn connected to one input of the addition section 20.

Overflow compensation circuits 33, 34 are provided for modifying the value of effective bit data to a suitable value(for example, the maximum value), considering that when the addition section 20 is used as a simple adder (i.e., when it is not used, for example, as a counter of a predetermined modulo number which presupposes an overflow), the data value of the effective bits will become a small value far away from the true addition result in case a carry signal is produced from the uppermost bit of the effective bits.

To the input of the register R1 is connected the TG bus 35, the output of the register R1 being connected to the multifunctional shifter 25. The input of the register R2 is also connected to the TG bus, the output of the register R2 being given to the code control circuit 23. The output of the code control circuit 23 is connected to the other input of the addition section 20 via the AND circuit 24.

A first parallel-to-serial converter PS1 converts parallel data given from the TG bus 35 to serial data, which is then applied to the AND circuit 24. The parallel data is a multiplier for multiplication operation. A second parallel-to-serial converter PS2 takes in low frequency modulating data LFO derived from a low frequency oscillator 37, and outputs the data LFO in serial data form to the AND circuit 24 as a multiplier.

Each of the abovementioned circuits in the tone signal generating device 10 has its operation controlled by the control signals, namely, microcodes from the microcode ROM 26. Accordingly, each of the circuits is constructed as to have individual predetermined microcodes inputted thereto, illustration of such construction however being omitted.

A CPU input-output control section 38 receives each of the abovementioned data CHN, KC, KON, PN, TD, VLM and implements controls that are directed to any of appropriate circuits in the tone signal generating device 10. The control section 38 also implements controls for giving the CPU bus 14 any of necessary data generated in the tone signal generating device 10.

A system clock generator 39 produces system clock pulses to be supplied to any of appropriate circuits.

A microcode address generator 40 sequentially produces addresses for reading the microcodes out from the microcode ROM 26 at the timing based on the system clock pulses. In the microcode ROM 26, various microcodes are programmed such that various operation and control functions as well as processing functions may be carried out sequentially in a predetermined sequence.

An envelope control unit 41, which is provided to implement the controls for envelope waveform generation, is mainly engaged in the state management of the envelope waveform generation, control of generation of operation rate data and control of generation of operation target level data. The state management means a management on which one of the envelope waveform portions, i.e., attack, decay, sustain, release etc. is to be currently generated.

A pitch generator 42 accumulates numerical value data based on the P number PN and generates rate data PGRT, PGFR indicative of variations of the phase addresses. The phase address rate data comprises an integer portion PGRT and a decimal portion PGFR, the integer portion PGRT being used for the increment of the address signal for reading from data memory, while the decimal portion PGFR being used for the interpolation operation of the tone waveform.

The generation of the microcodes from the microcode ROM 26, the control of the envelope waveform generation in the envelope control unit 41, and the generation of the phase address rate data PGRT, PGFR are implemented on plural-channel time division basis in accordance with predetermined time division timing.

Figure 3:
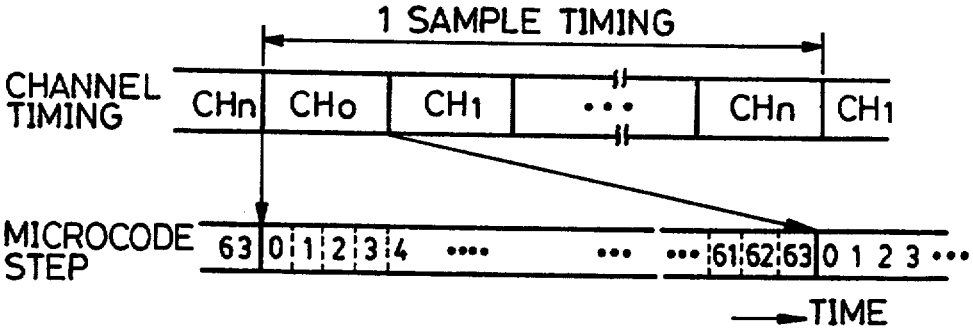
FIG. 3 illustrates, by way of example, the relationship between a sample timing, channel time division timing and microcode step timing within one channel.

FIG. 3 illustrates by way of example the relationship between one sampling timing, time division timing of each channel CHo–CHn, and microcode steps within one channel. In this example, there are 64 microcode steps within one channel timing; that is, each circuit in the tone signal generating device 10 performs time division operation by 64 steps to generate one sample of tone waveform related to one channel.

A tone data RAM 36 is a randomly readable and writable memory that is adapted to store various data necessary for tone signal generation for each of the channels. The data input and output lines of the tone data RAM 36 are connected to the TG bus 35. A RAM control section 43, which serves to control the data reading and writing of the tone data RAM 36, performs address designation as well as read/write instructions.

To this RAM control section 43, are inputted the outputs of the CPU input-output control section 38, envelope control unit 41 and microcode ROM 26, and predetermined signals produced from each of the other circuits, based on which the RAM control section 43 controls the reading and writing of the tone data RAM.

Description on the general operation

Rough brief on the operation will now be given prior to going into the details. In a case where the addition section 20 is used in an address signal operation for tone waveform generation, operation to add the integer portion PGRT of the abovementioned phase address rate data to the value of the previous address signal is carried out in the addition section 20, then a phase address signal generated from the addition section 20 is latched into the address latch ADL, and thence waveform sample data is read out from the data memory 27 in accordance with the address signal.

Also, an address signal is produced using the addition section 20 in correspondence to a selected tone color (voice number VN), key scaling data or touch data, then, thus produced address signal is latched into the address latch ADL, and thence envelope parameter data is read out from the data memory 27 in accordance with the address signal. The read-out envelope parameter data is then written into the tone data RAM 36. The envelope parameter data is read out from the tone data RAM 36 to be given to an envelope control unit 41 where envelope waveform variation data is made and operated in the addition section 20 so that an envelope waveform signal generation operation is performed.

Also, an amplitude level scaling operation is performed by the use of the addition section 20 on the basis of the waveform data read out as described, amplitude level setting data of, for example, the envelope waveform signal generated in the manner described, so that the amplitude level of the waveform sample data is set.

Further, an operation to interpolate between adjacent waveform sample data in accordance with the decimal portion PGFR of the abovementioned phase address rate data is performed by the use of the addition section 20 so that the waveform sample data can be generated minutely.

Thus, the waveform sample data generated for each channel and having the amplitude level already controlled is applied to an accumulator 44, in which the waveform sample data of all the channels related to one sample timing are accumulated together. The accumulated output is converted to an analogue signal by digital-to-analogue converter 45 to be subsequently outputted through an output circuit 46.

The essential components will now be described in detail.

Tone Data RAM 36

Figure 4:
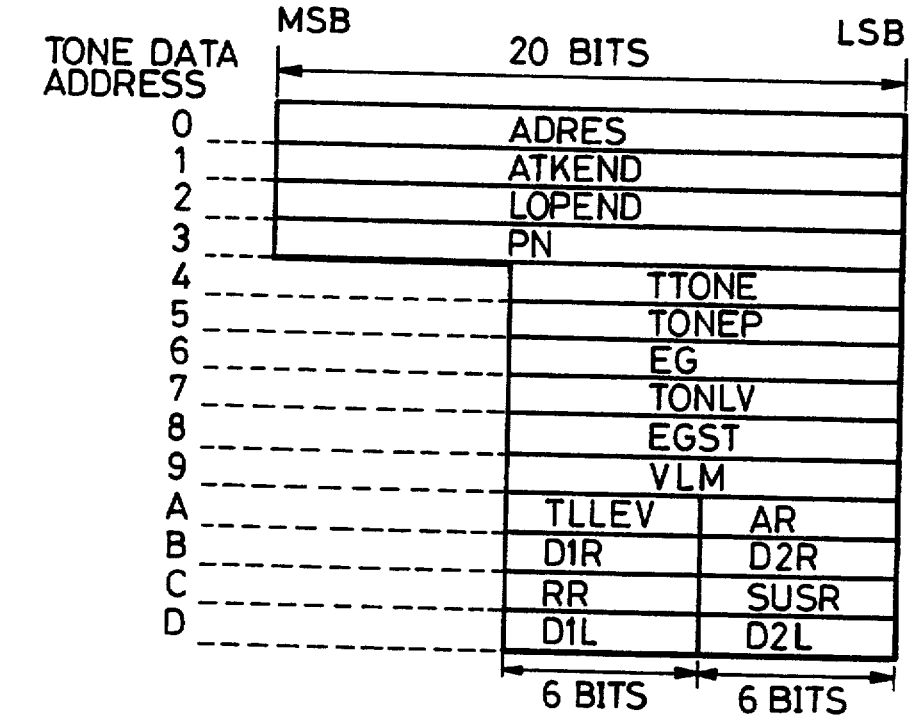
FIG. 4 illustrates, by way of example, a memory map of a tone data memory area for one channel reserved in a tone data RAM.

A memory map of tone data memory area for one channel which is reserved in the tone data RAM 36 is schematically shown in FIG. 4. The tone data memory for one channel has 14 addresses as tone data addresses, each of the addresses having a data size of 20 bits. Many data at the tone data addresses are written at the time of key-on event in the following manner.

When a new depressed key has been assigned to a certain channel, a channel number CHN indicative of the assigned channel, a key code KC indicative of the key assigned to the channel, a key-on signal KON, a P number PN, a touch data TD, a voice number VN and a tone volume setting data VLM are given from CPU11 to the CPU input-output control section 38 via the CPU bus 14.

The tone data memory area of the channel indicated by the channel number CHN is designated in the tone data RAM 36, the P number PN is stored at the tone data address 3 in the designated tone data, and the tone volume setting data VLM is stored at the tone data address 9.

Also, a voice data area of the data memory 27 is accessed in accordance with the voice number VN to read out necessary data.

Figure 5:
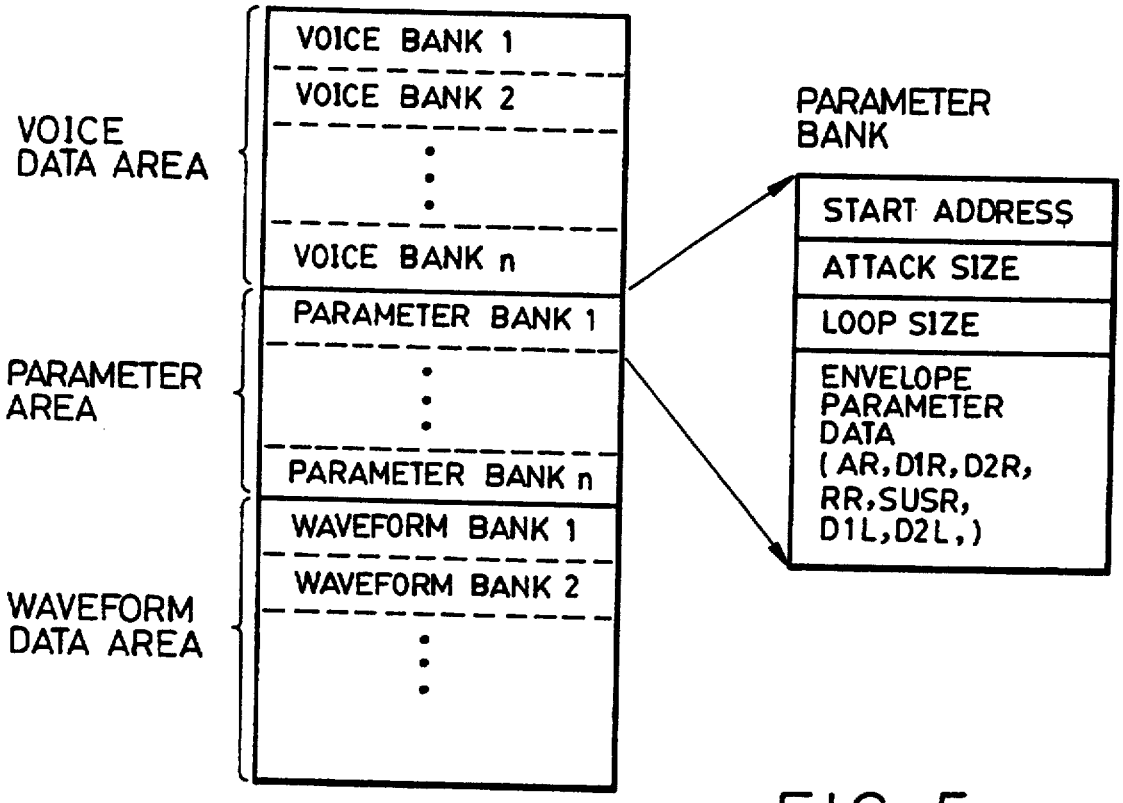
FIG. 5 schematically illustrates a memory map of a data memory shown in FIG. 1.

A memory map of the data memory 27 is schematically shown in FIG. 5 and it includes a voice data area, a parameter area and a waveform data area. The voice data area contains a plurality of voice banks 1–n. In each of the voice banks, information designating a parameter bank in the parameter area is stored. The parameter area contains a plurality of parameter banks 1–n. In each of the parameter banks, information designating a waveform data bank in the waveform data area and envelope parameter data are stored. The waveform data area contains a plurality of waveform data banks 1–n. In each of the waveform data banks, waveform sample data of plural-cycle waveform is stored. The waveforms stored in one waveform data bank are for example a complete waveform of the attack portion and a plural-cycle waveform of the repetition portion. In one parameter bank, state address data, attack size data and loop size data are stored as the information designating a waveform data bank, while attack rate data AR, first decay rate data D1R, second decay rate data D2R, release rate data PR, sustain rate data SUSR, first decay level data D1L and second decay level data D2L are stored as the envelope parameter data. The start address data denotes a head address of the waveform data bank to be designated, the attack size data denotes the number of addresses storing the complete waveform of the attack portion in the associated waveform data bank, and the loop size data denotes the number of the entire addresses in the associated waveform data bank.

Data of one voice bank is read out which corresponds to the tone color being currently selected in accordance with the voice number VN. When key scaling and/or touch control are performed, each of the voice banks is allowed to read out the information designating a parameter bank in the parameter area in accordance with the key code KC and/or the touch data TD as well as the voice number VN, and is also allowed to read out level control data and envelope rate control data for key scaling and/or touch control. Accordingly, in that case, a voice data area is accessed in accordance with the voice number VN and key code KC and/or touch data TD.

Data is read out from the parameter bank in accordance with the parameter bank designating information that has been read out as described. First, the start address data is stored as phase address current value data ADREB in the tone data RAM 36 at the tone data address 0 of the tone data memory area of the channel indicated by the channel number CHN, and this current value data ADRES becomes the initial value of the phase address signal. The phase address current value data ADRES is thereafter renewed successively.

An attack end address ATKEND is prepared by adding to the start address data read out from the parameter bank attack size data also read out, and this attack end address ATKEND is stored in the tone data RAM 36 at the tone data address 1 of the tone data memory area of the channel indicated by the channel number CHN. Further, a loop end address LOPEND is prepared by adding to the start address loop size data that has been also read out, and this loop end address LOPEND is stored in the RAM 38 at the tone data address 2 of the tone data memory area of the channel indicated by the channel number CHN. In this case, addition operation, although not described specifically, may be performed by means of the addition section 20.

Envelope parameter data AR, D1R, D2R, RR, SUSR, D1L, D2L read out from the parameter bank are stored in the tone data RAM 38 respectively at the tone data addresses A(H)–D(H) of the tone data area of the channel indicated by the channel number CHN. These data are composed of 6 bits and are stored respectively at the lower 6 bits and the upper 6 bits of the associated tone data address. In this case, the envelope parameter data as modified by the abovementioned envelope rate control data and the level control data may be stored in the RAM 38.

At the lower 6 bits of the tone data address A(H) of the tone data memory area in the tone data RAM 38, the abovementioned attack rate data AR is stored, while at the upper 6 bits, total level data TLLEV is stored. This total level data TLLEV is such data that sets the total level in view of the abovementioned level control data for key scaling and/or touch control.

At the tone data addresses 4 and 5 of the tone data area in the RAM 36, 2 waveform sample data TTONE, TONEP for interpolating between waveform sample data are stored respectively. TONEP is waveform sample data that has been read out by the previous phase address signal, and TTONE is waveform sample data that has been read out at this time by a new phase address signal, this being the interpolation target value.

At the tone address 6 of the tone data memory area in the RAM 36, envelope calculation value data EG is stored. This envelope calculation value data EG is the current value of an envelope waveform signal obtained by an envelope waveform generation operation.

Tone level data TONLV is stored at the tone data address 7 of the tone data memory area in the RAM 36. This tone level data TONLV is such data that is proportional to the current amplitude level of a tone signal. As an example usage of the data TONLV, it is conceivable that the current amplitude level of a tone signal is feed back to rate data for envelope waveform generation and the rate data is modified so that exponential (or logarithmic) envelope waveform curve can be given. Thus, the tone level data TONLV is utilized in the envelope control unit 41.

At the tone data address 6 of the tone data memory area in the RAM 38, an envelope state signal EGST is stored. This signal EGST indicates the current state of the envelope waveform generation operation being performed under the controls by the envelope control unit 41; in other words, it indicates which of the individual states, attack, decay, sustain, release etc. is being currently performed. The envelope state signal EGST is given-from the envelope control unit 41 and is stored in the RAM 36. The envelope control unit 41, through its own processes, first instructs of the attack state based on the key-on event and thereafter changes the state as required in accordance with the result of comparison between the target levels of the respective states and envelope calculation data values EG. In this case, the level comparison process itself is performed using the addition section 20, as will be hereinafter described.

Detailed Example of Adder Section 20 and Its Peripherals

Figure 6:
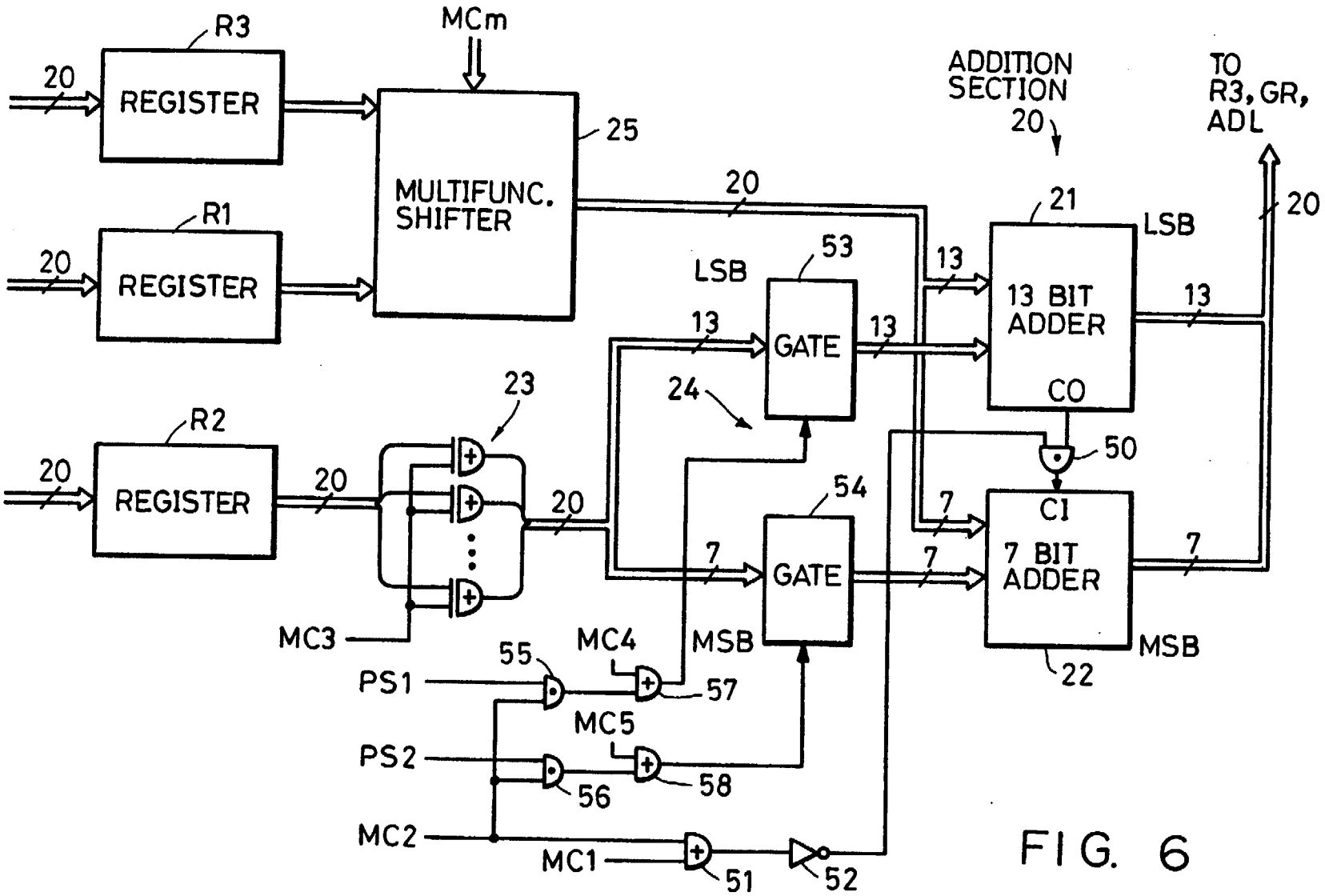
FIG. 6 is a block diagram illustrating in detail an addition section and its peripheral circuits shown in FIG. 1.

FIG. 6 illustrates the addition section 20 and its peripheral circuits somewhat in detail. The addition section 20, as a whole, comprises a 20-bit full adder, and more specifically it is composed of an adder 21 in the form of a 13-bit full adder for sharing the lower 13 bits and an adder 22 in the form of a 7-bit full adder 22 for sharing the upper 7 bits. An AND gate 50 is provided between a carry signal output CO of the lower 13-bit adder 21 and a carry signal input CI of the upper-7 bit adder 22, and this AND gate 50 is controlled in accordance with microcodes. When the AND gate 50 is enabled, the addition section 20 functions as a 20-bit full adder. When the AND gate 50 is not enabled, however, the adders 21 and 22 are separated from each other , so that the addition section 20 functions as a 13-bit full adder or a 7-bit full adder.

In this manner, the effective bit number of the addition section 20 becomes 20 or 13 (or 7) by the control of the AND gate 50 and thus can be varied depending on specific purposes. When separated from each other, the two adders 21, 22 can also perform different operations in parallel.

A microcode MC1 instructing of the separation of the adders is applied through an OR gate 51 to an inverter 52 to be inverted and then applied to the AND gate 50, so that when the microcode MC1 is "1", it disables the AND gate 50 to separate the adders 21 and 22 from each other. In this case, the effective bit number of the addition section 20 is changed.

A microcode MC2 instructing that two kinds of multiplications be performed in parallel is applied through the OR gate 51 to the inverter 52 to be inverted and then applied to the AND gate 50, so that when the microcode MC2 is "1", the AND gate 50 is also disabled so as to separate the adders 21 and 22 from each other. In this case, two different kinds of operations are performed in parallel in the addition section 20.

Each of the registers R1, R2, R3, GR is capable of storing data in 20-bit parallel form. The code control circuit 23 comprises exclusive OR circuits for 20 bits which have 20 bit outputs of the register R2 inputted thereto, to each of which exclusive OR circuit is given a microcode MC3 for code control. When a subtraction operation is to be performed in the addition section 20 with the output data of the register R2 being as a subtracter, the microcode MC3 is made "1", and the output data of the register R2 is inverted to be the complement.

When a normal addition operation is to be performed, the microcode MC3 is "0" so that the output data of the register R2 passes through the code control circuit 23 without being inverted.

The AND circuit 24 comprises a gate 53 corresponding to the lower 13 bits and a gate 54 corresponding to the upper 7 bits. The lower 13 bits of the 20 bit output of the code control circuit 23 are applied through the gate 53 to one input of the adder 21, while the upper 7 bits are applied through the gate 54 to one input of the adder 22.

To a control input of the gate 53, serial data outputted from the first parallel-to-serial converter PS1 is given via an AND gate 55. To a control input of the gate 54, serial data outputted from the second parallel-to-serial converter PS2 is given via an AND gate 58. These serial data are equivalent to multipliers in multiplication operation. The AND gate 55, 58 are enabled by the microcode MC2 instructing of parallel multiplications. Thus, the input data of the gates 53, 54 are passed when the serial data bit is "1" and are prevented (made "0") when the microcode MC2 is "0". With this, partial products corresponding to the respective multiplier bits are obtained. As will be described later, each of the adder 21, 22 adds up the partial products corresponding to the respective multiplier bits so as to obtain a final product. Such multiplication operations in the respective adders 21, 22 are performed individually in parallel.

In order to cause the gates 53, 54 to be normally open when addition and subtraction operations are to be performed, microcodes MC4, MC5 are applied to the respective control inputs of the gates 53, 54. When only the lower 13-bit adder 21 is to be effectively used, the gate 54 may be closed by making the microcode MC4 "1" and the microcode MC5 "0".

The 20-bit output of the register R1 or R3 is applied through the multifunctional shifter 25 to the addition section 20. The lower 13 bits of the 20-bit output of the multifunctional shifter 25 are applied to the other input of the adder 21, and the upper 7 bits are applied to the other input of the adder 22. The multifunctional shifter 25, as described above, performs various functions such as data shift process, selection, passage, blockage, temporary storage of data etc. The shifter 25 also does an overflow compensation process to prevent an error from being caused by an overflow of the effective data in a case where the data shift has been performed.

Obviously, predetermined microcodes are also given to the individual registers R1, R2, R3, GR so as to control the introduction of data from the TG bus 35 or the addition section 20.

Detailed Description on Various Operations

Figure 7A:
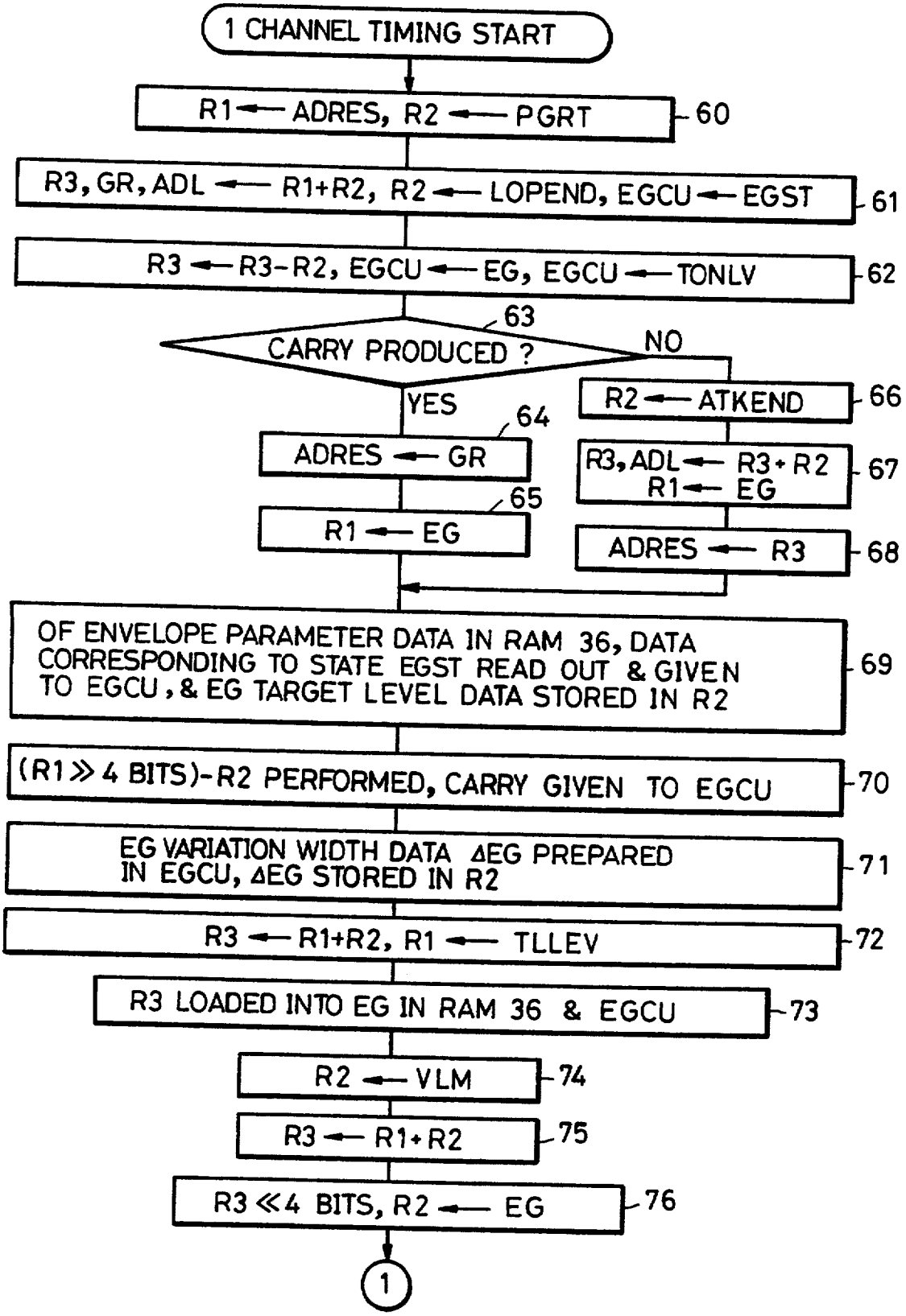
FIGS. 7A, 7B and 7C are flow charts illustrating examples of various processes carried out in FIG. 1 in accordance with microcodes generated from a microcode ROM.
Figure 7B:
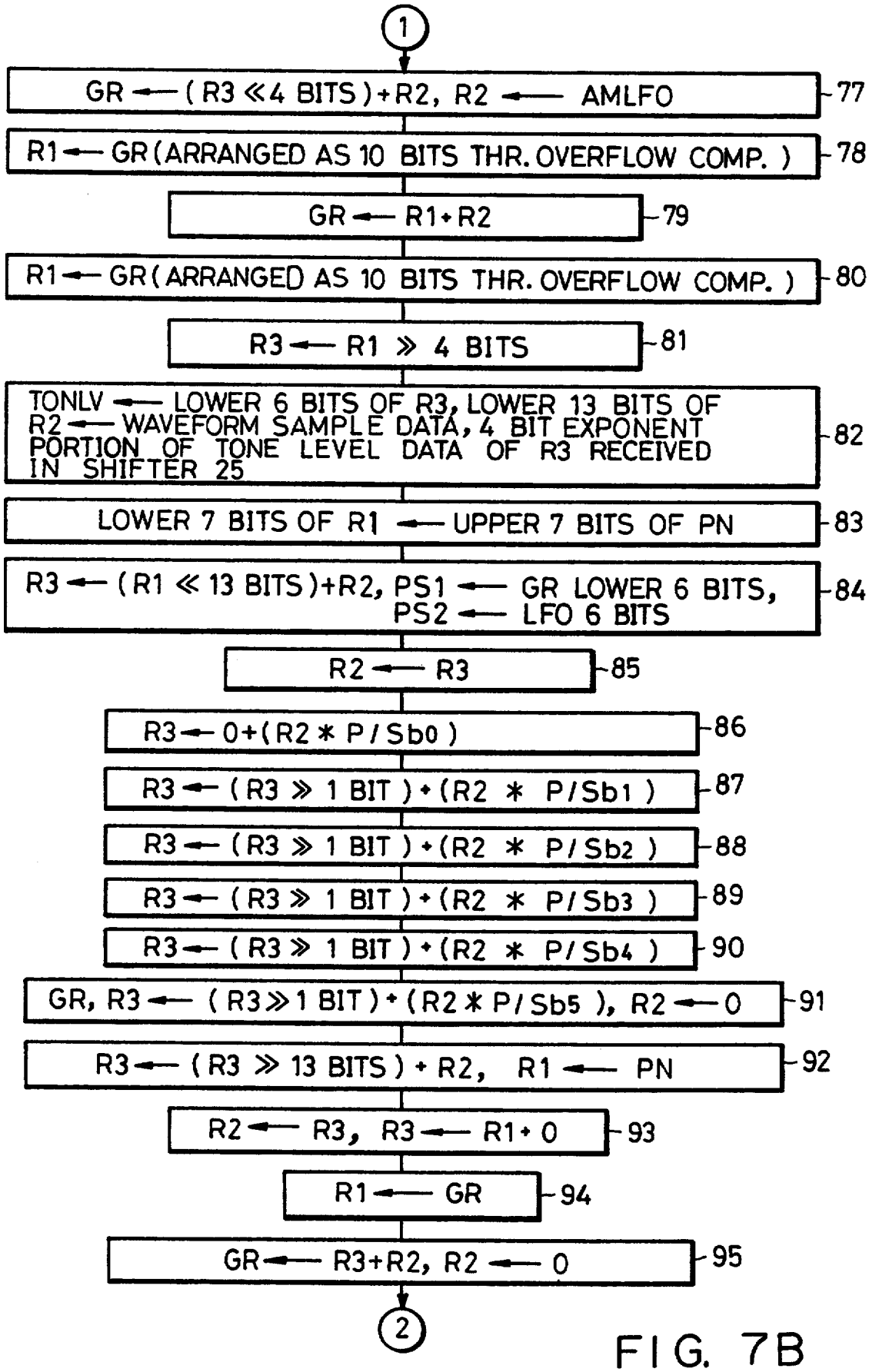
Figure 7C:
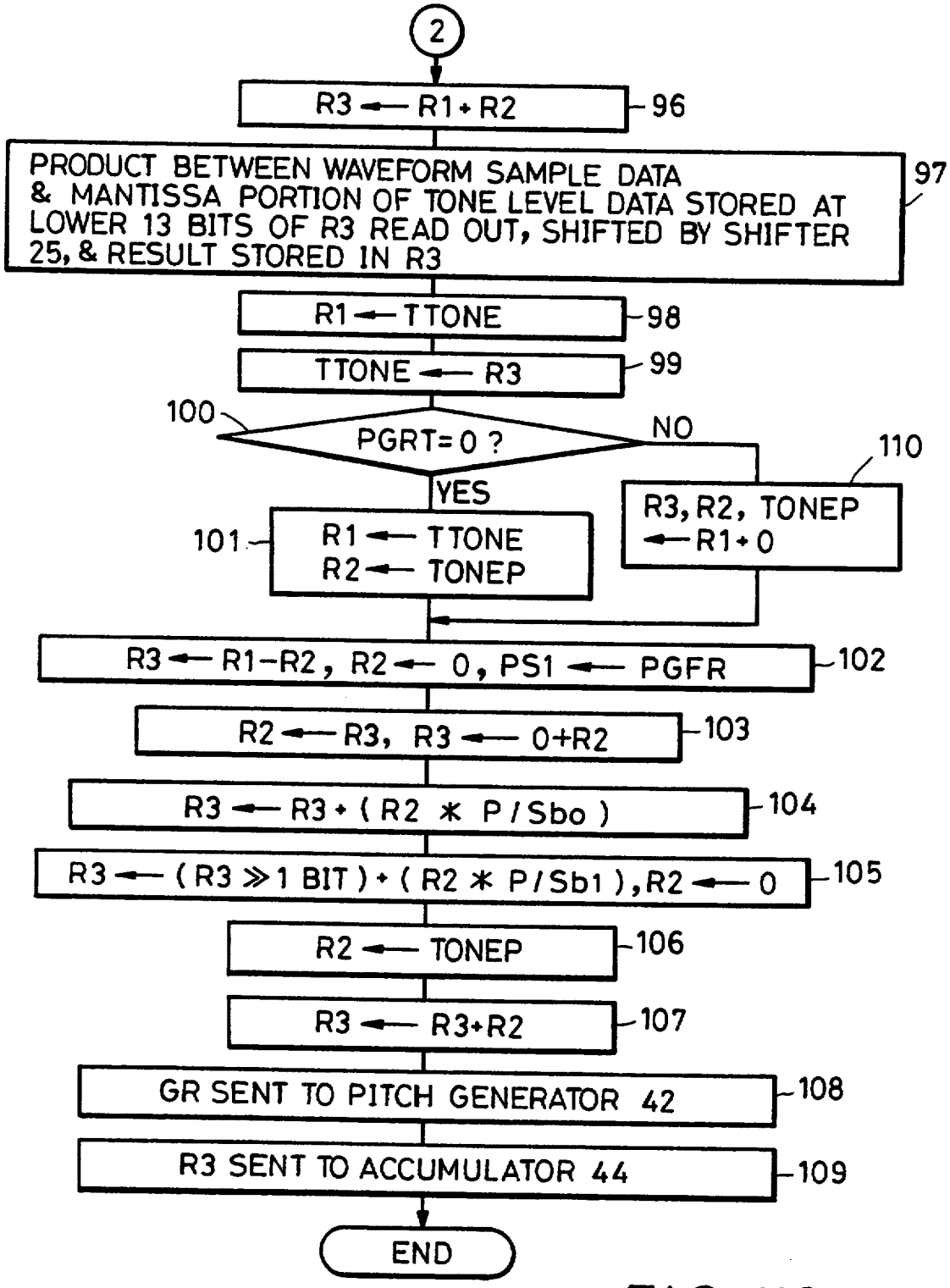

FIGS. 7A, 7B and 7C are flow charts illustrating examples of various processes to be performed in accordance with microcodes produced from the microcode ROM 26. The various processes will now be described based on these figures.

(1) Phase Address Operation

First, phase address current value data ADRES is read out from the tone data RAM 36 and stored in the register R1 (step 60). Also, the integer portion PGRT of phase address rate data generated from the pitch generator 42 is stored in the register R2 (step 80). It is now assumed that each of the registers etc. is operating based on two-phase clock pulses and that data received at the latter half of a certain microcode step timing is outputted synchronously with the rise of the next microcode step timing. Therefore, it is possible to output data and to receive other data at the same microcode step timing.

Next, the outputs of the registers R1, R2 are added together in the addition section 20 (step 61). In this connection, the microcodes shown in FIG. 6 are set in the following manner:

MC1="0", MC2="0", MC3="0", MC4="1", MC5="1", MC5="1", MCm=R1 select.

Thus, the addition section 20 does normal addition operation with all of the 20 bits being as the effective bits to perform R1+R2, the result of which is then received by the registers R3, G3 and the address latch ADL. In a case where the operation is performed with all of the 20 bits of the addition section 20 being as the effective bits as mentioned, calculation time corresponding to two clock pulses is required due to propagation delay of a carry signal. Therefore, the timing at which the result of the addition is received in the registers R3, GR, ADL coincides with the next microcode step timing.

In this manner, the integer portion PGRT of the phase address rate data is added to the phase address current value data ADRES so that the phase address current value ADRES increases by the amount of the PGRT and the phase address increment is done. Consequently, a phase address signal after increment is stored in the registers R3, GR, ADL.

Although this operation is performed at each channel timing, the integer portion PGRT of the phase address rate data is produced only at the variation timing and is "0" at the non-variation timing. Accordingly, there is no substantial change in the phase address current value ADRES in a case where an addition result has been PGRT="0". Even in this case, the decimal portion PGFC of the phase address rate data will have been produced so that interpolation is done as described later. The format of the phase address rate data produced from the pitch generator 42 may be schematically shown as in FIG. 8A.

A loop end address LOPEND is read out from the tone data RAM 38 and stored in the register R2 (step 61). Also, an envelope state signal EGST is read out from the tone data RAM 38 and given to the envelope control unit 41 (abbreviated to EGCU).

(2) Address Comparison

Next, the loop end address LOPEND is subtracted from the phase address operation value (step 62). In this connection, the microcodes shown in FIG. 6 are set as follows:

MC1="0", MC2="0", MC3="1", MC4="1", MC5="1", MCm=R3 select.

With these, the addition section 20 performs the subtraction of R3−R2 with all of the 20 bits being as the effective bits. Then, the result is received in the register R3.

This subtraction of R3−R2 is performed for "address comparison" to examine whether the phase address operation value has exceeded the loop end address LOPEND; that is, if the phase address operation value has not yet reached the loop end address LOPEND, then R3<R2, so that a carry signal is produced from the addition section 20 which is executing an interpolation operation. On the other hand, if the phase address operation value has exceeded the loop end address LOPEND, then R3>R2, so that no carry signal is produced from the addition section 20 and the operation result R3−R2 will be indicating a fractional number exceeding the loop end address LOPEND. Thus, the result of "address comparison" will be known from whether or not a carry signal has been produced from the addition section 20.

Envelope calculation data EG and tone level data TONLV are read out from the tone data RAM 36 and given to the envelope control unit 41 (step 62).

Next, whether or not a carry signal has been produced from the addition section 20 is examined (step 63). If the examination result is YES, it is meant that the phase address operation value is effective because it has not yet reached the loop end address LOPED, and thus the phase address operation value of the register GR is stored as a new phase address current value data ADRES in the tone data RAM 36. Next, the envelope calculation value data EG is read out from the tone data RAM 36 and stored in the register R1 (step 65).

(3) Fraction Operation at Repetition Time

If the phase address operation value has exceeded the loop end address LOPEND, an attack end address ATKEND is read out from the tone data RAM 36 and stored in the register R2 (step 66).

Next, outputs of the registers R3, R2 are added together in the addition section 20 (step 67). In this connection, microcodes shown in FIG. 6 are set as follows:

MC1="0", MC2="0", MC3="0", MC4="1", MC5="1", MCm=R3 select.

With these, the addition section 20 does normal addition operation with all the 20 bits being the effective bits, to perform R3+R2. Then, the result is received in the register R3 and the address latch ADL. In this case, the data of the register R3 is the operation result of R3−R2 in the previous step 62 and will be indicating a fractional address exceeding the loop end address LOPEND. Accordingly, addition of the fractional address to the attack end address ATKEND is obtained and received as a new phase address signal in the address latch ADL and also stored in the register R3.

Also, the envelope calculation data EG is read out from the tone data RAM 36 and stored in the register R1 (step 67).

Next, the data of the register R3 is stored as a new address current value data ADRES in the tone data RAM 36 (step 68).

In this manner, a process for return from the loop end address LOPEND to the attack end address ATKEND is performed, and control is made for repeatedly reading out waveforms of the repetition portion.

(4) Envelope Level Comparison

Next, of the envelope parameter data AR, D1R, D2R, RR, SUSR, D1L, D2L stored in the tone data RAM 36, rate data and level data corresponding to the current envelope state EGST are read out and given to the envelope control unit 41 (step 69). Also, EG target level data in the current envelope state is stored in the register R2.

Next, the envelope calculation value data EG stored in the register R1 is shifted downwardly by 4 bits by the multifunctional shifter 25, and the EG target level data is subtracted from the output data of this multifunctional shifter 25 (step 70). In this connection, microcodes shown in FIG. 6 are set as follows:

MC1="1", MC2="0", MC3="1", MC4="1", MC5="0", MCm=R1 select and 4 bit downward shift.

With these, in the addition section 20, the lower 13-bit adder 21 is enabled, and the subtraction operation of R1>>4 bits−R2 is performed with 13 effective bits. In the case of 13-bit operation like this, propagation delay of a carry signal falls within the calculation time for one clock pulse so that the operation can be completed within one microcode step timing.

The reason why the envelope calculation value data stored in the register R1 is shifted by 4 bits downwardly is to match the digit order of the envelope calculation data EG with that of the EG target level data. More specifically, format of the envelope calculation data EG is schematically shown as in FIG. 8B. The data EG is 10-effective-bit data of which upper 4 bits constitute an exponent portion and of which lower 6 bits constitute a mantissa portion. In contrast, the EG target level data is 6-effective-bit data and is stored at the lower 6 bits of the register R2. Thus, the upper 6-bit portion of the envelope calculation data EG is shifted by 4 bits downwardly so that its digit order can be matched with that of the EG target level data.

This subtraction operation of R>>4 bits−R2 is performed for comparison purpose to determine whether the current envelope calculation value data EG is larger or smaller than the EG target level data. That is to say, if the envelope calculation value data EG is smaller than the EG target level data, then (R1>>4 bits)<R2, so that there will be produced a carry signal from the addition section 20 which is performing interpolation operation. On the other hand, if the envelope calculation value data EG is larger than the EG target level data, then (R1>>4 bits)>R2, so that there will be produced a carry signal from the addition section 20 which is performing interpolation operation. Consequently, the result of "envelope level comparison" will be known on the basis of whether or not a carry signal has been produced from the addition section 20. The carry signal from the addition section 20 is given to the envelope control unit 41 to be used for controlling an inclination code of an envelope waveforms.

In the envelope control unit 41, envelope level variation width data ΔEG is prepared on the basis of the envelope rate data. This data ΔEG has a positive or negative code imparted thereto depending on the presence or absence of the carry signal from the addition section 20; that is, in the case of the negative code, the variation width data ΔEG is given in the form of complement. This code-controlled envelope level variation width data ΔEG is stored in the register R2 (step 71). In the envelope control unit 41, state management is being done all the time, and if it has been determined to renew the state, an envelope state signal EGST is renewed to be stored in the tone data RAM 36.

(5) Envelope Current Value Operation

Next, the envelope calculation value data EG stored in the register R1 and the envelope level variation width data ΔEG stored in the register R2 are added together (step 72). In this connection, microcodes shown in FIG. 6 are set as follows:

MC1−"1", MC2="0", MC3="0", MC4="1", MC5="0", MCm=R1 select

With these, the lower 13-bit adder 21 is enabled in the addition section 20, so that the addition section 20 does normal addition operation to perform R1+R2. The operation result is received in the register R3. However, since the envelope level variation width data ΔEG has already been code-controlled as mentioned above, addition or subtraction operation is in practice performed in accordance with its positive or negative code.

In this manner, the envelope calculation value data EG increases or decreases by the amount corresponding to the variation width data ΔEG so that new envelope calculation value data is obtained to be stored in the register R3.

Also, total level data TLLEV is read out from the tone data RAM 36 and stored in the register R1 (step 72).

The new envelope calculation value data thus stored in the register R3 is written as new envelope calculation data EG into the tone data RAM 36 and also given to the envelope control unit 41 (step 73).

(6) Total Level Operation

Next, tone volume setting data VLM is read out from the tone data RAM 36 and stored in the register R2 (step 74).

Then, the total level data TLLEV stored in the register R1 and the tone volume setting data VLM stored in the register R2 are added together in the addition section 20 (step 75). In this connection, microcodes shown in FIG. 6 are set as follows:

MC1—"1", MC2="0", MC3="0", MC4="1", MC5="0", MCm=R1 select.

With these, the lower 13-bit adder 21 is enabled in the addition section 20, which does normal addition operation to perform R1+R2. Then, the operation result is received in the register R3.

Thus, the total level data TLLEV corresponding to key scaling and/or touch control, and the tone volume setting data VLM that has been manually set are added together to be stored in the register R3 as the total level control data that sets the total level of a tone.

(7) Operation of EG and Total Level Control Data

Next, a process in which the total level control data is shifted by 4 bits upwardly is performed along with the overflow compensation process (step 76). This is because the effective bits of the total level control data are stored at the lower 6 bits in the register R3 and it is necessary to shift the 6 bits by 4 bits upwardly so that the 6 bits may be positionally matched with the uppermost 6 bits of the effective 10 bits of the envelope calculation value data EG.

Also, the envelope calculation value data EG is read out from the tone data RAM 38 and stored in the register R2.

Then, the total level control data that has been shifted by 4 bits upwardly (R3<<4 bits) is added with the envelope calculation value data EG (step 77). In this connection, microcodes shown in FIG. 6 are set as follows:

MC1="1", MC2="0", MC3="0", MC4="1", MC5="0", MCm=R3 select and 4 bit upward shift.

With these, the lower 13-bit adder 21 is enabled in the addition section 20 so that the addition operation of R3<<4 bits+R2 is performed with the 13 effective bits. The addition operation result is stored in the register GR. In this manner, the total level control data is added to the envelope calculation value data EG.

Also, amplitude modulating low frequency data AMLFO is received from the low frequency oscillator 37 and this data AMLFO is stored in the register R2.

(8) Amplitude Modulating Operation

Next, the result of operation between the total level control data stored in the register GR and the envelope calculation value data EG is arranged as 10-bit data through the overflow compensation process in the overflow compensation circuit 33, and thus arranged data is stored in the register R1 (step 78).

Then, the total-level-controlled envelope calculation value data that is stored in the register R1 is added with the amplitude modulating low frequency data AMLFO stored in the register R2 (step 79). In this connection, microcodes shown in FIG. 6 are set as follows:

MC1="1", MC2="0", MC3="0", MC4="1", MC5="0", MCm=R1 select.

With these, the lower 13-bit adder 21 is enabled in the addition section 20, and the addition operation of R1+R2 is performed with the 13 effective bits. The result of the addition operation is stored in the register GR. In this manner, the envelope calculation value data that has been controlled by the total level control data is further controlled by the amplitude modulating low frequency data.

Figures 8A, 8B, 8C:
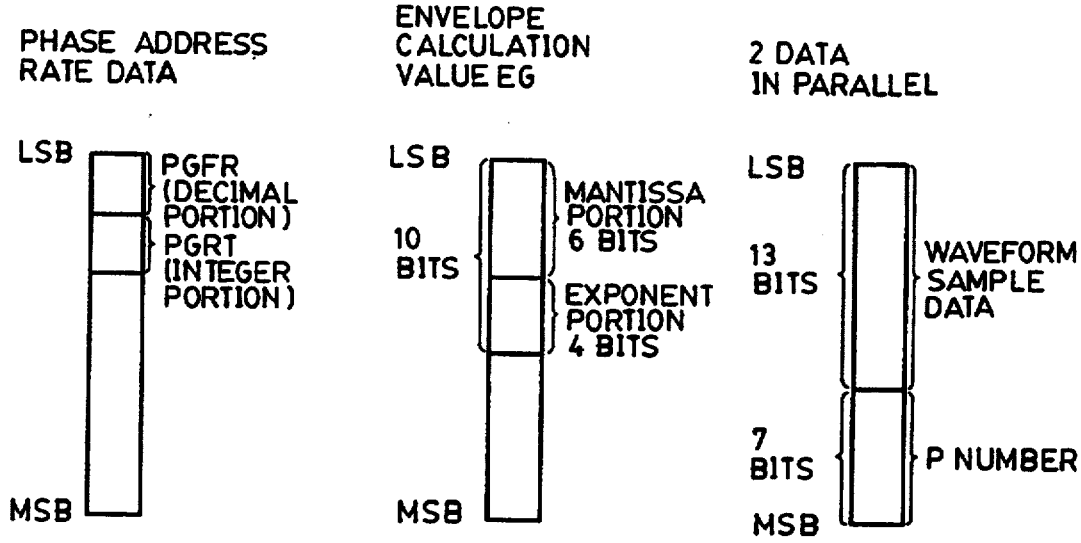
FIGS. 8A, 8B and 8C schematically illustrate formats of various data.

Then, the operation result stored in the register GR (i.e., the total-level-controlled envelope calculation value data, this being hereinafter referred to as tone level data) is arranged as 10-bit data through the overflow compensation process in the overflow compensation circuit 33, and thus arranged data is stored in the register R1 (step 80). The reason why the tone level data is arranged as 10-bit data is that it needs to be matched to the format of the envelope calculation data EG as shown in FIG. 8B.

(9) Parallel Operations of Level Multiplication of Waveform Sample Data and Vibrato Data Preparation Multiplication of P Number Next, the total-level-controlled envelope calculation value data, i.e., tone level data is shifted by 4 bits downwardly in the multifunctional shifter 25 and then stored in the register R3 (step 81). This is for the purpose of positioning the upper 6 bits of the tone level data at the lowermost 6 bits of the register R3.

Then, the upper 6 bits of the tone level data positioned at the lowermost 6 bits of the register R3 is written as tone level data TONLV in the tone data RAM 36 (step 82).

Also, waveform sample data is read out from the data memory 27 in accordance with the phase address signal stored in the address latch ADL and the data is stored in the register R2 in such manner that the upper 13 bits may be positioned at the lower 13 bits of the register R2.

Further, of the tone level data stored in the register R1, data at the upper 4-bit exponent portion is received and stored in a register within the multifunctional shifter 25.

Next, P number PN is read out from the tone data RAM 36 and stored in the register R1 (step 83) in such manner that the upper 7 bits of the P number PN may be positionally matched to the lower 7 bits of the register R1.

Subsequently, the output of the register R1 that has been shifted by 13 bits downwardly (R1<<13 bits) is added with the output of the register R2 (step 84). In this connection, microcodes shown in FIG. 6 are set as follows:

MC1="1", MC2="0", MC3="0", MC4="1", MC5="1", MCm=R1 select and 13 bit upward shift.

In other words, by MC1="1", it is instructed that the addition section 20 be separated into the adders 21 and 22; by MC4="1" MC5="1", both of the gates 53, 54 are enabled so that the two adders 21, 22 are separated for parallel use. Since the 7-bit input signal to the gate 54 is "0", MC5 may alternatively be "0".

The upper 7 bits of the P number, which is stored at the lower 7 bits of the register R1, is shifted upwardly by 13 bits so that the upper 7 bits of the P number PN may be positioned at the uppermost 7 bits of 20-bit data and inputted to the upper 7-bit adder 22. The upper 13 bits of sample data, which is stored at the lower 13 bits of the register R2, pass through the gate 53 to be inputted to the lower 13-bit adder 21.

Thus, the addition section 20 positions the upper 13-bit data of the waveform sample data and the upper 7-bit data of the P number at the lower 13 bits and upper 7 bits, respectively, for carrying out a process to place both of the data in parallel as data of 20 total bits. The parallel placement of both of the data is shown in FIG. 8C. The output of the addition section 20 is stored in the register R3.

Further, of the tone level data stored in the register GR, data at the lower 6-bit mantissa portion is received in the first parallel-to-serial converter PS1. Also, low frequency data LFO generated from the low frequency oscillator 37 for imparting a vibrato effect is received in the second parallel-to-serial converter PS2. This low frequency data LFO is also 6-bit format data.

Subsequently, the parallel data composed of the 13-bit waveform sample data stored in the register R3 and the 7-bit P number data PN is received in the register R2 (step 85).

At the step timings of the next steps 86–91, the 6-bit data is serially outputted from the parallel-to-serial converters PS1, PS2 so that the mantissa portion data of the tone level data serially outputted from the first parallel-to-serial converter PS1 is serially multiplied with the waveform sample data stored in the lower 13 bits of the register R2 by means of the gate 53 and the adder 21, while the low frequency data serially outputted from the second parallel-to-serial converter PS2 is serially multiplied with the P number PN stored in the upper 7 bits of the register R2 by means of the gate 54 and the adder 22.

In this connection, microcodes shown in FIG. 6 are set follows:

MC1="0", MC2="1", MC3="0", MC4="0", MC5="0".

In other words, by MC2="1", it is instructed that parallel multiplications be performed, so that the AND gates 55, 56 are enabled to pass the serial data derived from the parallel-to-serial converters to the gates 53, 54. It is also instructed that the addition section 20 be separated into the adders 21 and 22 to perform operations respectively therein. When the serial data to be applied to the gates 53, 54 is "1", the output data of the register R2 is passed to the adders 21, 22. When the serial data to be applied to the gates 53, 54 is "0", the output data of the register R2 is blocked, so that "0" is inputted to each of the adders 21, 22. In other words, ANDs between the output data of the register R2 and the serial data are obtained by the gates 53, 54, and operations are performed for obtaining partial products.

The output of the addition section 20 is received in the register R3, output of which is shifted as required by the multifunctional shifter 25 in accordance with the microcode MCm and inputted to the addition section 20 for being added to the partial products from the gates 53, 54. That is to say, in the register R3 is received the sum of the partial products.

The microcode MCm to the multifunctional shifter 25 sequentially shifts the sum of the partial products already obtained, so as to implement digit order matching (weight matching) with partial products to be summed up next. At the first serial multiplication timing (step 86), output of MCm=blockage, i.e., "0" is instructed. At the following serial multiplication timings (steps 87–91), MCm=R3 select and 1 bit downward shift is instructed (R3>>1). It is now assumed that the serial data is sequentially transferred from the lower bit. In the drawings, P/Sb0 denotes the lowermost bit of the serial data, and P/Sb1–P/Sb5 denote bits which upwardly increase in the order mentioned.

At the last step 91 for completing the serial multiplication, the output of the addition section 20, i.e., multiplication result is received in the registers R3 and GR, and "0" is set in the register R2.

Thus, the result of multiplication between the mantissa portion data of the tone level data and the waveform sample data is stored at the lower 13 bits of the registers R3, GR, while the result of multiplication between the 7-bit low frequency data LFO and the P number PN is stored at the upper 7 bits of the registers R3, GR.

(10) Vibrato Modulating Operation of P Number PN

Next, the output of the register R3 that has been downwardly shifted by 13 bits in the multifunctional shifter 25 (R3>>13 bits) is added with the output of the register R2 ("0"), the result of which is stored in the register R3 (step 92). Thus, the result of multiplication between the 7-bit low frequency data LFO and the P number PN is caused to he positioned at the lowermost 7 bits in the register R3. The result of multiplication between the 7-bit low frequency data LFO and the P number PN is hereinafter referred to as vibrato data because it is used as coefficient data for vibrato modulation. Further, the P number is read out from the tone data RAM 36 and stored in the register R1 (step 92).

Then, the vibrato data of the register R3 is taken in the register R2, and the P number PN of the register R1 is taken in the register R3 (step 93).

After that, the result of multiplication between the mantissa portion data of the tone level data and the waveform sample data, and the result of multiplication between the low frequency data LFO and the P number PN, which are positioned in parallel respectively at the lower 13 bits and upper 7 bits of the register GR, are received and stored in the register R1 (step 94).

Subsequently, the vibrato data of the register R2 is added to the P number PN of the register R3, the result of which is stored in the register GR (step 95). Also, "0" is set in the register R2. In this connection, microcodes shown in FIG. 6 are set as follows:

MC1="0", MC2="0", MC3="0", MC4="1", MC5="1", MCm=R3 select.

With these, the addition section 20 does normal addition operation using all of 20 bits as effective bits, to perform R3+R2. Thus, the P number PN comprising 20 effective bits is added with minute vibrato data for vibrato modulation. Then, the P number PN that has undergone such vibrato modulation is stored in the register GR.

(11) Exponent Portion Level Operation on Waveform Sample Data with Already Operated Mantissa Portion Level Next, "0" of the register R2 is added to the results of multiplications between the mantissa portion data of the tone level data and the waveform sample data, and the low frequency data LFO and the P number PN, which are parallelly positioned and stored at the lower 13 bits and upper 7 bits, respectively. The addition result is stored in the register R3 (step 96). In this case, the addition section 20 is caused to perform normal addition operation using all of 20 bits as the effective bits. 20-total-bit data of the register R1 is transferred through the addition section 20 to the register R3.

Then, the result of multiplication between the mantissa portion data of the tone level data and the waveform sample data, which is stored at the lower 13 bits of the register R3, is taken in the multifunctional shifter 25, and it is bit-shifted in accordance with the exponent portion of the tone level data that has been stored in the shifter 25 at the previous step 82, the result of which is taken in the register R3 via the addition section 20 (step 97).

In this way, the waveform sample data that has been level-controlled by both of the mantissa and exponent portions of the tone level data is stored in the register R3.

(13) Interpolation Operation

Next, interpolation-target sample data TTONE is read out from the tone data RAM 36 and stored in the register R1 (step 98).

Then, the level-controlled waveform sample data stored in the register R3 is written into the tone data RAM 36 as new interpolation-target sample data TTONE (step 99).

After that, it is examined whether or not the integer portion PGRT of the phase address rate data is "0" (step 100). If PGRT is "0", then it is meant that the interpolation-target sample data TTONE has not changed at the current timing and waveform sample data should be generated by means of interpolation operation.

Hence, the interpolation-target sample data TTONE is read out from the tone data RAM 36 and stored in the register R1. Also, interpolation-start sample data TONEP is read out from the tone data RAM 36 and stored in the register R2 (step 101).

Subsequently, the subtraction operation of R1−R2, i.e., TTONE−TONEP is performed, the result of which is stored in the register R3 (step 102). In this connection, microcodes shown in FIG. 6 are set as follows:

MC1="0", MC2="0", MC3="1", MC4="1", MC5="1", MCm=R1 select.

Hence, the addition section 20 does subtraction operation of 20 effective bits, so as to obtain R1−R2. This is the example case where 20 bits are made the effective bits; alternatively, if 13 bits are made the effective bits, subtraction operation of 13 effective bits may of course be made in the addition section 20.

Further, the register R2 is set at "0", and the decimal portion PGFR of the phase address rate data generated from the pitch generator 42 is loaded into the first parallel-to-serial converter PS1.

After that, the data of the register R3 (data indicative of difference between the interpolation-target sample TTONE and the interpolation-start sample data TONEP) is transferred to the register R2, and 0+R2, namely, "0" is stored in the register R3 (step 103).

At the step timings of the following steps 104, 105, the decimal portion data of 2 bits is serially outputted from the first parallel-to-serial converter PS1 and is then serially multiplied with the difference data TTONE−TONEP of the register R2 by means of the gate 53 and the addition section 21. In this connection, microcodes shown in FIG. 6 may be set as in the abovementioned serial multiplication.

The multiplication result that has been finally obtained in this manner is stored in the register R3. The multiplication result is indicative of variation width relative to the interpolation-start sample data TONEP at the associated interpolation steps.

Next, the interpolation-start sample data TONEP is stored in the register R2 (step 106), and the addition operation of R3+R2 is done to add the variation width to the interpolation-start sample data TONEP, the result of which is stored in the register R3 (step 107). In this connection, microcodes shown in FIG. 6 may be set as in the abovementioned normal addition operation. In this manner, the waveform sample data obtained through interpolation is stored in the register R3.

Subsequently, the vibrato-modulated P number PN that has been stored in the register GR is given to the pitch generator 42, so that it is utilized for P number accumulation in the pitch generator 42 (step 108).

At the last step 109, the interpolated waveform sample data stored in the register R3 is sent to the accumulator 44 (FIG. 1).

If the integer portion PGRT is not "0" in the determination of step 100, it is meant that the interpolation-target sample data TTONE has changed at the current timing. In this case, the previous interpolation-start sample data TONEP stored in the register R1 is stored in the registers R3, R2 and then written into the tone data RAM 36 as interpolation-start sample data TONEP (step 110). Then, R1−R2="0" is done at the next step 102, "0" is stored in the register R3 as the serial multiplication result of steps 104, 105, and the interpolated waveform sample data obtained at step 107 is caused to be the same as the interpolation-start sample data TONEP. In this way, at the interpolation start step, the previous interpolation-target sample data TTONE becomes the interpolation-start sample data TONEP, and it is outputted as already interpolated waveform sample data.

It is to be noted that when the addition section 20 is to be separated, separation of course need not be at the position of the 13th lower bit. Further, the number of separation is not restricted to 2 but may be more. In other words, the number of operation groups for parallel operations is not limited to 2 but can be set at more than that.

As has been described so far, according to the present invention, since operation circuits to perform various operations for tone signal generation are integrated into a single addition means so that the addition means can be shared, there will be achieved superior advantageous results that circuitry construction can be significantly reduced. Also, because the number of effective bits of the addition means is changeable, calculation time when sharing the single addition means for operations on various data of different characteristics can be efficiently used. Further, because the addition means can be separated into two or more independent addition circuits so that different operations can be performed in parallel respectively in the addition circuits, it is possible to perform parallel operations as required when implementing operations on data of different characteristics and thus to improve operation efficiency, which is extremely advantageous.

What is claimed is:

1. A tone signal generating device which comprises:

addition means, having two or more addition circuits, for performing an operation according to a first or second operation style in response to a first control signal, wherein different operations are performed in parallel in the respective addition circuits in said first operation style and a common operation is performed in said addition circuits in said second operation style;

memory means for storing data to be inputted to said addition means;

processing means for variably performing a logical processing on output data of said memory means in accordance with a second control signal and giving the data to said addition means;

data storage means for storing waveform sample data; and control means for controlling introduction of data to said memory means and generation of said first and second control signals in correspondence to respective desired operations so that plural kinds of operations for tone signal generation may be respectively performed, the data to be introduced to said memory means and contents of the logical processing of said processing means being determined in accordance with a control by said control means, so that said addition means can be shared for at least first and second kinds of operations for the tone signal generation, said first kind of operation being an operation for generating an address signal for accessing said data storage means, said first control signal designating said second operation style for said first kind of operation, said second kind of operation being an operation for processing waveform sample data read out from said data storage means in response to said address signal, said first control signal designating said first operation style for said second kind of operation; and serial multiplier supplying means for supplying serial multiplier data for respective ones of said addition circuits when said first operation style is designated so that respective addition circuits each function as part of a different multiplication operator to effect said second kind of operations.

2. A tone signal generating device as defined in claim 1 wherein said addition means is capable of changing a number of its effective bits in accordance with the first control signal given from said control means.

3. A tone signal generating device as defined in claim 1, further comprising a gate, and wherein said addition circuits are connected with each other via a gate, and one or more of said addition circuits is selectively enabled by controlling said gate in accordance with the first control signal given from said control means, in such manner that the number of the effective bits of the entire addition means is changed.

4. A tone signal generating device as defined in claim 1 wherein said second kind of operation is an amplitude level scaling operation with respect to said waveform sample data.

5. A tone signal generating device as defined in claim 4 wherein said control means performs a control such that said addition means is also shared for a tone waveform interpolation operation.

6. A tone signal generating device as defined in claim 4 or 5 wherein in accordance with the number of the effective bits of data in the individual operations, the operations are classified into one where said addition means is separatedly used for performing plural parallel operations and another where said addition means is used for a single operation, so that said parallel and single operations in accordance with the classification are respectively performed on time divisional basis.

7. A tone signal generating device as defined in claim 4 wherein said data storage means further stores envelope parameter data, said control means further performs a control such that said addition means is shared for said address signal operation, said amplitude level scaling operation and an envelope waveform signal generation operation, said envelope waveform signal generation operation is performed on the basis of the envelope parameter data read out from said data storage means so as to generate an envelope waveform signal and said amplitude level scaling operation is performed on the basis of said waveform sample data and said envelope waveform signal.

8. A tone signal generating device as defined in claim 1 wherein said processing means performs logical processings such as shifting, gating, selection and inversion of data in accordance with the control signal.

9. A tone signal generating device as defined in claim 1 wherein said processing means includes means for performing a code control process for subtraction, means for performing an AND process for multiplication and means for performing a data shift process.

10. A tone signal generating device, comprising:

input means for inputting musical performance data designating a generation timing and a pitch of a tone to be generated;

memory means for storing waveform sample data;

reading means for reading out said waveform sample data from said memory means at a rate corresponding to said pitch designated by said performance data;

operation means, having an addition circuit, for executing first and second arithmetic operations in order to generate said tone;

control means for controlling said operation means such that said operation means generates an envelope signal to control an amplitude envelope of said tone in response to said performance data in said first arithmetic operation using said addition circuit, and such that said operation means provides said sample data read out by said reading means with said amplitude envelope according to said envelope signal in said second arithmetic operation using a predetermined portion of said addition circuit as part of a multiplication operator; and serial multiplier supplying means for, in said second arithmetic operation, supplying serial multiplier data for said predetermined portion of said addition circuit.

11. A tone signal generating device as defined in claim 10 wherein said another of said arithmetic operations is an operation of multiplying said sample data by said envelope signal, wherein said envelope signal is represented in an approximate logarithmic representation and said envelope signal is approximately converted to a linear representation simultaneously with said multiplication.

12. An electronic musical instrument comprising:

waveform memory means for storing waveform sample data;

control means for controlling operation of said electronic musical instrument; and tone generating means for generating a tone signal based on said waveform sample data read out from said waveform memory means;

said tone generating means comprising:

a bus for conveying data therealong;

adder means, connected to said bus, for executing addition and multiplication;

storage means, connected to said bus, for storing address data to access said waveform memory means and envelope control data to control an amplitude envelope of said tone signal;

communication means, connected to said bus, for receiving from said control means data to control said tone generating means;

clock generating means for generating clock signals, the clock signals being used for time-divisionally controlling plural operations of said tone generating means; and output means, connected to said bus, for outputting said tone signal generated by said tone generating means, said adder means renewing said address signal to access said waveform memory means, said adder means generating an envelope signal based on said envelope control data, and said adder means further multiplying the sample data read out from said waveform memory means by said envelope signal.

13. A tone generating device, comprising:

frequency data generating means for generating frequency data designating the pitch of a tone to be generated;

memory means for storing waveform sample data;

address generator means for generating address signals, each of which has an integer portion and a decimal portion, at regular time intervals according to said frequency data, and for supplying said integer portion to said memory means as a readout address;

interpolating means for receiving said sample data read out from said memory means in response to said integer portion of said address and interpolating between at least two sample data designated by said integer portion according to said decimal portion to output interpolated sample data as an output when said integer portion does not change between adjacent ones of said intervals, and outputting an uninterpolated sample data corresponding to said integer portion directly when said integer portion changes between adjacent ones of said intervals; and sound generating means for generating a tone signal based on said interpolated sample data and said uninterpolated sample data outputted from said interpolating means.

* * * * *